US007682196B1

(12) United States Patent
Peng

(10) Patent No.: US 7,682,196 B1
(45) Date of Patent: Mar. 23, 2010

(54) CABLE CONNECTOR

(75) Inventor: Yung-Chi Peng, Tu-Cheng (TW)

(73) Assignee: Cheng Uei Precision Industry, Co., Ltd., Taipei Hsien (TW)

( * ) Notice: Subject to any disclaimer, the term of this patent is extended or adjusted under 35 U.S.C. 154(b) by 0 days.

(21) Appl. No.: 12/379,571

(22) Filed: Feb. 25, 2009

(51) Int. Cl.
*H01R 13/648* (2006.01)

(52) U.S. Cl. ..... 439/607.56; 439/607.54

(58) Field of Classification Search .....
439/607.54–607.56, 607.47–607.49
See application file for complete search history.

(56) References Cited

U.S. PATENT DOCUMENTS 5,199,903 A * 4/1993 Asick et al. ..... 439/607.47
5,456,618 A * 10/1995 Nakamura ..... 439/607.48
6,113,427 A * 9/2000 Wu ..... 439/607.47
6,619,985 B1 * 9/2003 Ko ..... 439/607.54
6,659,801 B2 * 12/2003 Nishio et al. ..... 439/607.48
6,663,432 B2 * 12/2003 Inagawa ..... 439/607.48
7,086,901 B2 * 8/2006 Zhang ..... 439/607.56
2003/0104728 A1 * 6/2003 Inagawa et al. ..... 439/610
2004/0043658 A1 * 3/2004 Ko ..... 439/607

* cited by examiner

*Primary Examiner*—Gary F. Paumen
(74) *Attorney, Agent, or Firm*—Rosenberg, Klein & Lee

(57) ABSTRACT

A cable connector adapted for connecting with cables includes a plug insulating housing. The plug insulating housing has a basic body and an inserting portion extending frontward from a front surface of the basic body. A peripheral dimension of the inserting portion is less than that of the basic body. A plurality of plug terminals are received in the inserting portion and the basic body and connected with the cables mounted to the plug insulating housing and extend out from the basic body opposite to the inserting portion. A plug shell coupled with the plug insulating housing includes a top shell and a bottom shell connected to the top shell by at least one connecting portion attached to the front surface of the basic body. Both opposite sides of the bottom shell extend upwards and bend inwards to form a buckling portion clasping the top shell, respectively.

5 Claims, 6 Drawing Sheets

CABLE CONNECTOR

BACKGROUND OF THE INVENTION

1. Field of the Invention

The present invention generally relates to a connector, and more particularly to a cable connector having a shell with a steady and firm assembling structure.

2. The Related Art

Please refer to FIG. 1, a conventional cable connector generally involves an insulating housing 31', a plurality of terminals 34' mounted in the insulating housing 31' and a shell coupled with the insulating housing 31'. The shell includes a top shell 32' and a bottom shell 33'. The top shell 32' has a top covering plate 321'. Two ends of the top covering plate 321' extend outwards to form a protruding plate 322', respectively. The protruding plate 322' has a rear edge extending downwards to form a stopping plate 323'. A bottom of the stopping plate 323' extends frontward to form a buckling plate 324', with a buckling hole 325' formed thereon. The bottom shell 33' has a bottom covering plate 331'. The bottom covering plate 331' has two buckling pieces 333' corresponding to the buckling holes 325'. Two ends and two opposite sides of the bottom covering plate 331' have portions extending upwards to form a plurality of blocking plates 332' enclosing a periphery of the insulating housing 31'. In assembly, the top shell 32' is fixed to the bottom shell 33' by the buckling holes 325' engaging with the buckling pieces 333'. However, such assembling structure is not steady and firm, especially affected by an unexpected force. So there is a need to design an assembling structure for connecting the top shell with the bottom shell reliably.

SUMMARY OF THE INVENTION

An object of the present invention is to provide a cable connector having a structure for connecting a top shell and a bottom shell reliably. The cable connector adapted for connecting with cables has a plug insulating housing. The plug insulating housing has a basic body and an inserting portion extending frontward from a front surface of the basic body. A peripheral dimension of the inserting portion is less than that of the basic body. A plurality of plug terminals are received in the inserting portion and the basic body and connected with the cables which are mounted to the plug insulating housing by one end thereof and extend out from the basic body opposite to the inserting portion. A plug shell coupled with the plug insulating housing includes the top shell and the bottom shell connecting with the top shell by at least one connecting portion attached to the front surface of the basic body. Both opposite sides of the bottom shell are extended upwards and bent inwards to form a buckling portion clasping the top shell, respectively.

As described above, the connecting portion is connected with the top shell and the bottom shell, which avoids separating the top shell from the bottom shell in use. Furthermore, the buckling portion of the bottom shell clasps the top shell, which further fixes the top shell and the bottom shell together. Thus the top shell is connected with the bottom shell firmly and reliably, without easy to separate from each other even if affected by an unexpected force.

BRIEF DESCRIPTION OF THE DRAWINGS

The present invention will be apparent to those skilled in the art by reading the following description of an embodiment thereof, with reference to the accompanying drawings, in which.

DETAILED DESCRIPTION OF THE EMBODIMENT

Figure 1:
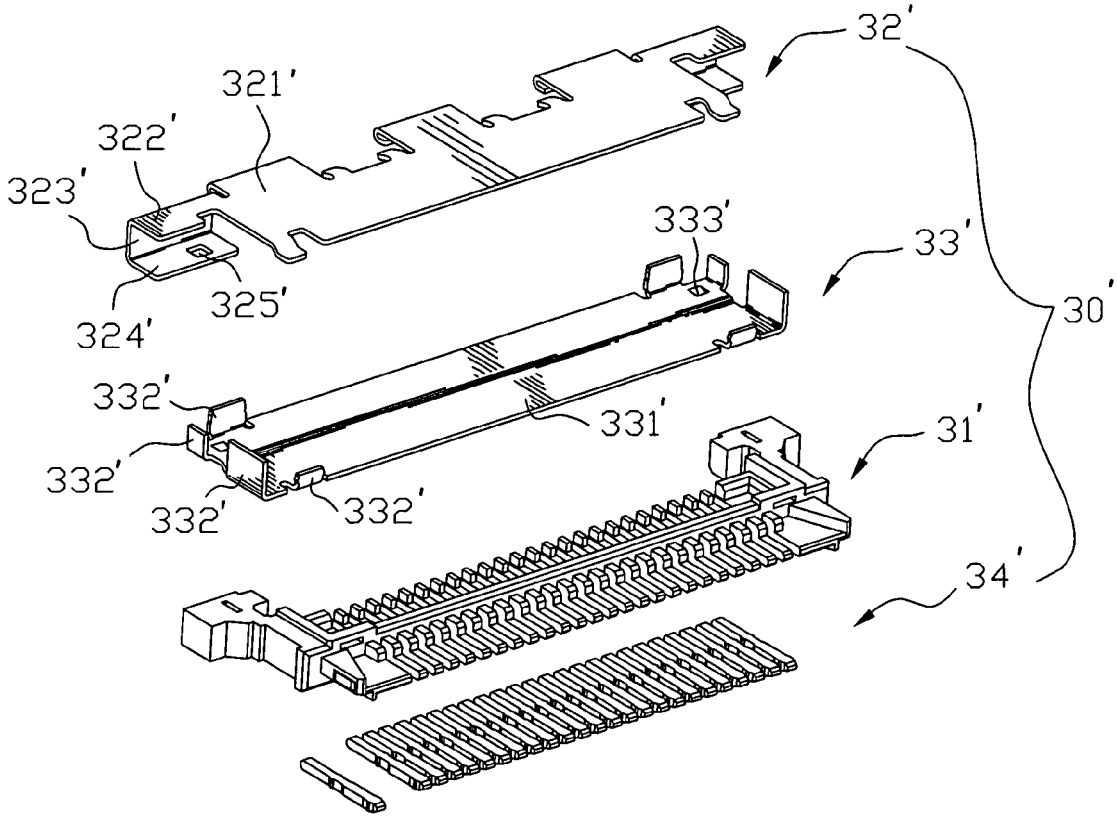
FIG. 1 (Prior Art)
FIG. 1 is an exploded, perspective view of a conventional cable connector.
Figure 2:
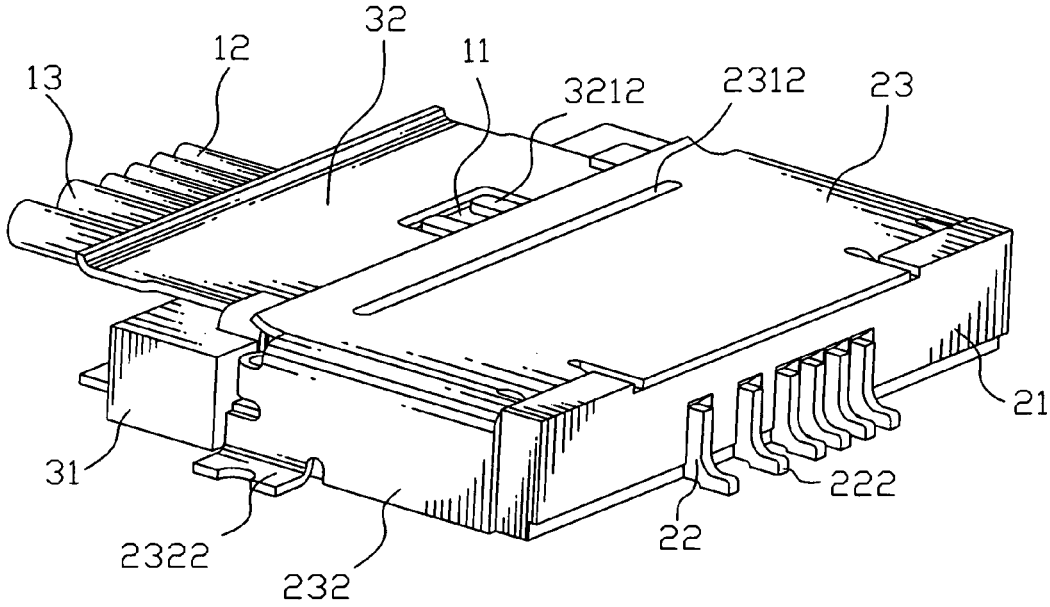
FIG. 2 is an assembled, perspective view of a cable connector of an embodiment according to the present invention.
Figure 3:
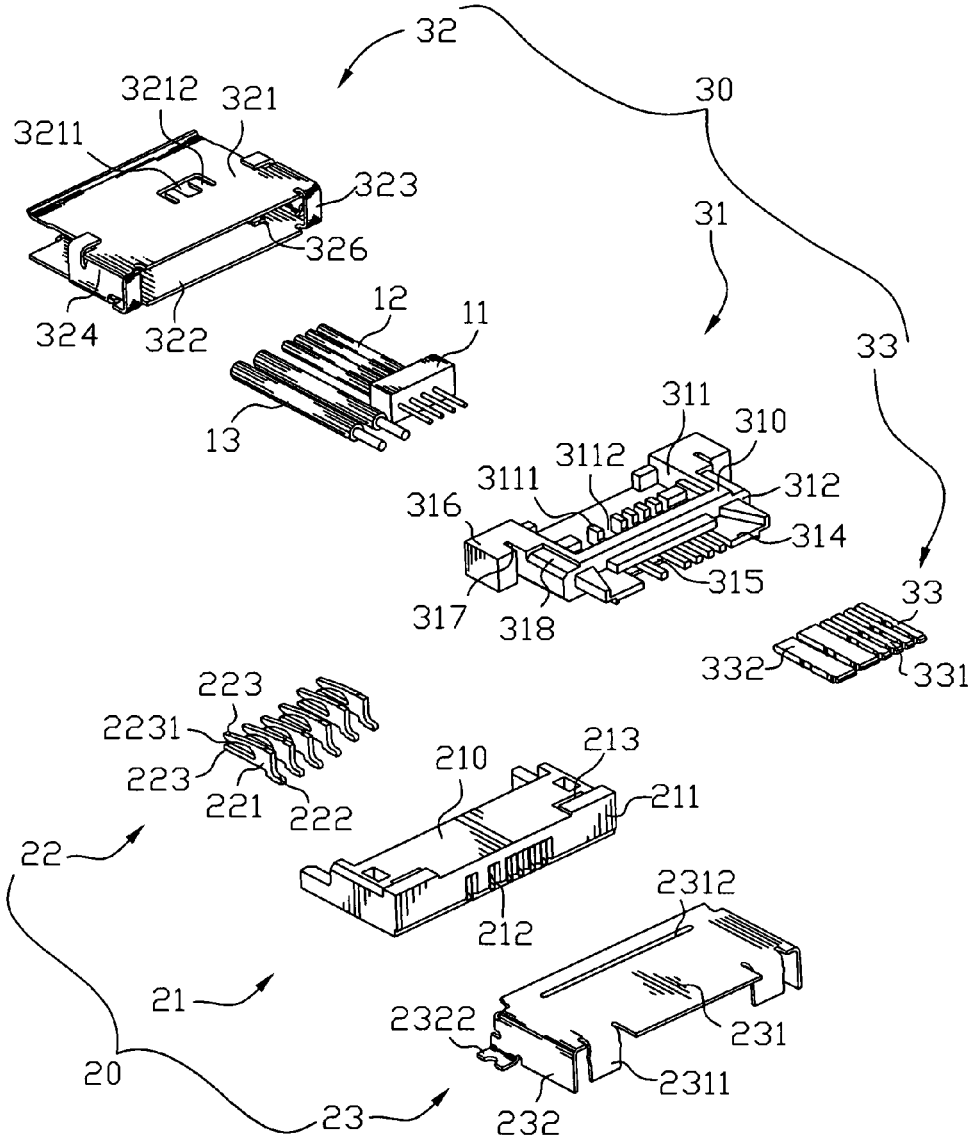
FIG. 3 is an exploded, perspective view of the cable connector shown in FIG. 2.

With reference to FIG. 2 and FIG. 3, a cable connector connected with a plurality of cables and a printed circuit board (PCB, not shown), includes a receptacle 20 and a plug 30 inserted into the receptacle 20. The receptacle 20 includes a receptacle insulating housing 21, a plurality of receptacle terminals 22 received in the receptacle insulating housing 21 and a receptacle shell 23 coupled with the receptacle insulating housing 21. The receptacle insulating housing 21 has a base 210 of substantially rectangular shape, defining a front 211. The front 211 has a plurality of grooves 212 extending rearwards and passing through the whole base 210. A top of the base 210 has two restraining slots 213, arranged in alignment with each other and adjacent to the front 211.

The receptacle terminals 22 are mounted in the grooves 212. Each of the receptacle terminals 22 has a fixing portion 221 of substantially rectangular shape. A lower portion of a front end of the fixing portion 221 extends frontward to form a soldering portion 222 for being soldered on the PCB. A rear end of the fixing portion 221 has two portions extending rearwards side by side and spaced away from each other to form holding portions 223. Distal ends of the holding portions 223 extend towards each other to form a protrusion 2231, respectively.

Figure 4:
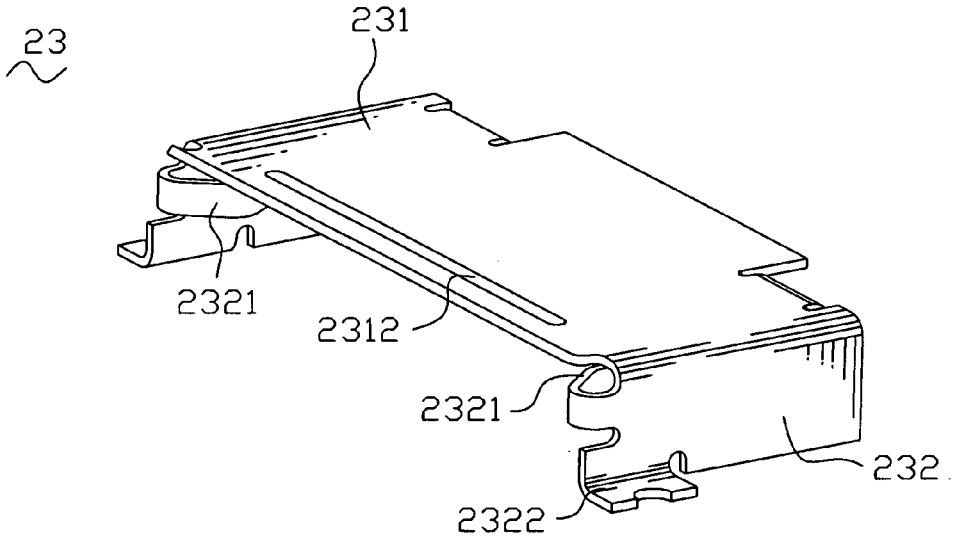
FIG. 4 is a perspective view of a receptacle shell of the cable connector shown in FIG. 2 seen from another angle.

Referring to FIGS. 2-4, the receptacle shell 23 has a receptacle covering plate 231 and a pair of lateral plates 232 extending downwards from two opposite sides of the receptacle covering plate 231 and flanked two sides of the receptacle insulating housing 21. The receptacle covering plate 231 is a rectangular shape. Two ends of a front of the receptacle covering plate 231 are bent downwards and extended to form a restraining plate 2311, respectively, inserted into the corresponding restraining slot 213 for fixing the receptacle shell 23 to the receptacle insulating housing 21. While a rear of the receptacle covering plate 231 is concaved inwards to form a cavity 2312 extending leftwards and rightwards for reinforcing the connection stability between the receptacle 20 and the plug 30. The lateral plate 232 has a rear edge extended and curved inwards to form an elastic arm 2321 adjacent to the cavity 2312, with a sharp angle formed therebetween. The elastic arm 2321 can be resiliently against the inserted plug 30 in assembly for enhancing the insertion and withdrawal force and the connection stability therebetween. A bottom of the lateral plate 232 extends outwards to form a soldering patch 2322 near the elastic arm 2321 for being soldered on the PCB.

Figure 5:
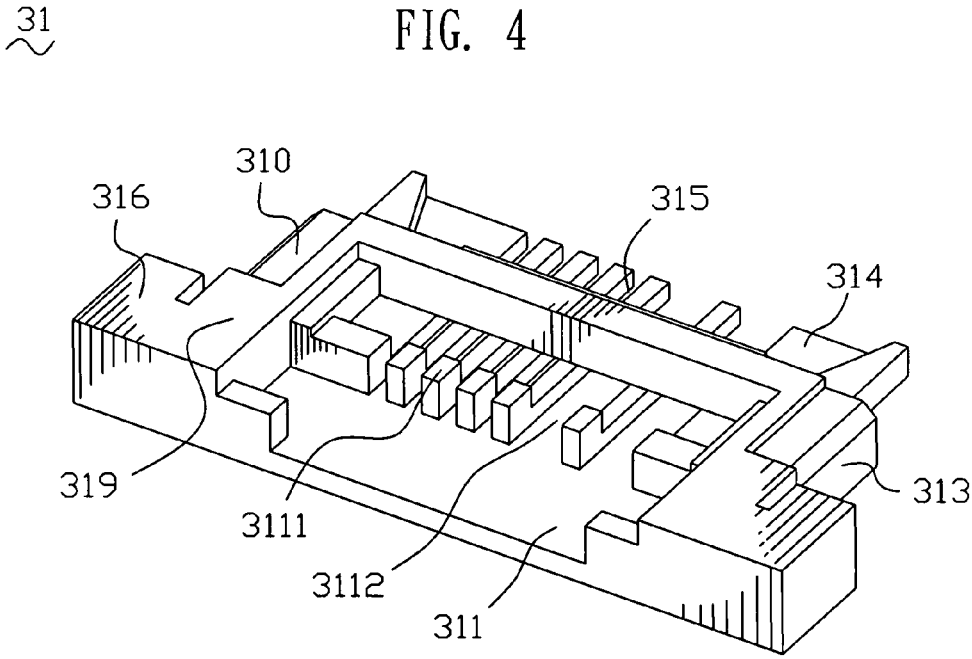
FIG. 5 is a perspective view of a plug insulating housing of the cable connector shown in FIG. 2 seen from another angle.

Please refer to FIG. 3 and FIG. 5, the plug 30 includes a plug insulating housing 31, a plurality of plug terminals 33 received in the plug insulating housing 31 and a plug shell 32 coupled with the plug insulating housing 31. The plug insulating housing 31 has a substantially rectangular basic body 310. The basic body 310 has a receiving cavity 311 at a top 319 thereof and defines a front surface 312 and two lateral surfaces 313. The receiving cavity 311 passes through a rear end of the basic body 310 and has a plurality of restraining lumps 3111 arranged breast to show a row parallel to the front surface 312 and spaced away from one another to form a plurality of stopping recesses 3112. In this embodiment, there are four first cables 12 restrained by a restraining portion 11 and two second cables 13 with diameter thereof greater than that of the first cables 12. The restraining portion 11 is oblong and received in the receiving cavity 311. The top 319 of the basic body 310 further has two buckling recesses 318 disposed at two corners thereof and passing through the front surface 312 and the lateral surfaces 313. The front surface 312 has a portion extended frontward to form an inserting portion 314, with a peripheral dimension thereof less than that of the basic body 310. The inserting portion 314 is formed with a plurality of terminal grooves 315 communicating with the receiving cavity 311 and aligned with the corresponding stopping recesses 3112 for receiving the plug terminals 33 of flat-board shape. In this embodiment, the terminal grooves 315 all pass through a bottom of the inserting portion 314 for making the receptacle terminals 22 clamp the plug terminals 33, respectively, and the plug terminals 33 include four first plug terminals 331 corresponding to the first cables 12 and two second plug terminals 332 corresponding to the second cables 13, a width of the first plug terminal 331 less than that of the second plug terminal 332. A rear end of each of the lateral surfaces 313 extends outwards and then bends frontward to form a blocking portion 316, with a blocking slot 317 formed therebetween.

Figure 6:
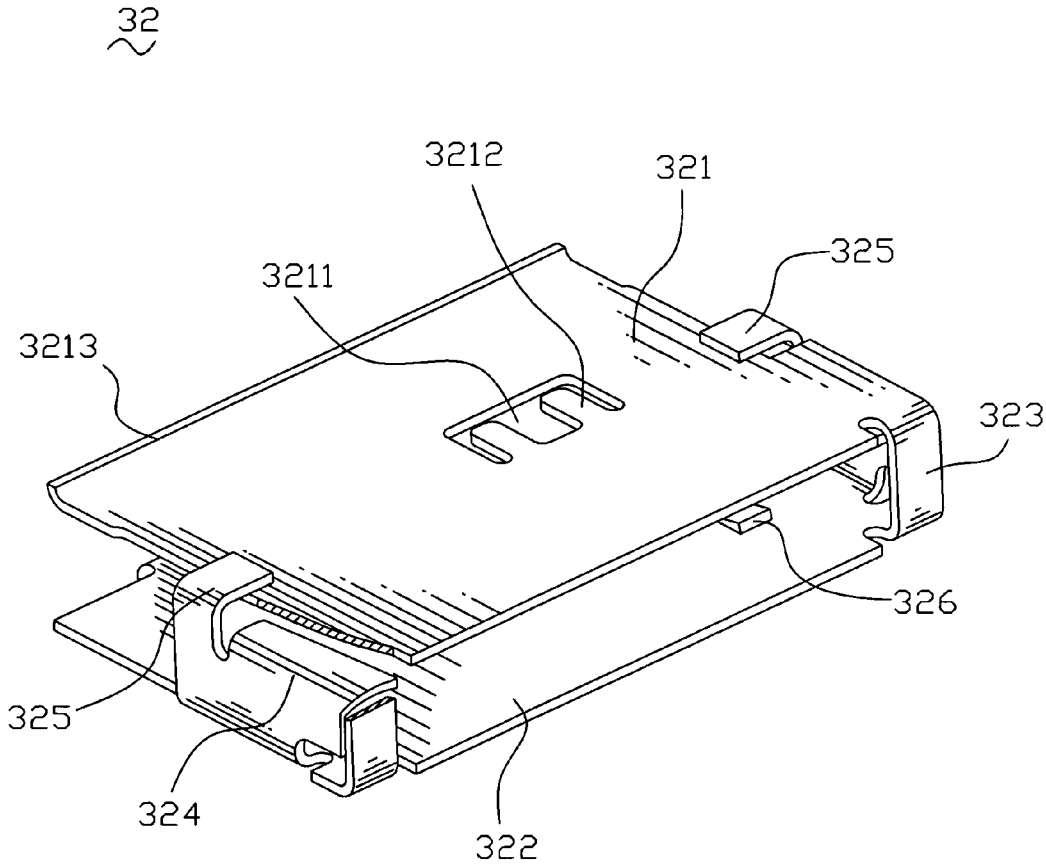
FIG. 6 is a partly sectional view of a plug shell of the cable connector shown in FIG. 2.

Please refer to FIG. 3 and FIG. 6, the plug shell 32 has a top shell 321 and a bottom shell 322. The top shell 321 has a soldering hole 3211 corresponding to the restraining portion 11 for conveniently soldering. A front edge of the soldering hole 3211 has two portions extending rearward to form soldering latches 3212 for being soldered on the restraining portion 11. A rear edge of the top shell 321 is bent upwards to form a leading portion 3213 for conveniently inserting the plug insulating housing 31 therein. Two connecting portions 323 are disposed to connect with two ends of a front edge of the top shell 321 and two ends of a front edge of the bottom shell 322. The connecting portion 323 is a narrow and short strip shape and attached to the front surface 312 of the basic body 310. The bottom shell 322 is substantially oblong. Each of two opposite sides of the bottom shell 322 has a portion adjacent to the connecting portion 323 extended upwards and then bent inwards to form a propping portion 324 underlying the top shell 321 for supporting the top shell 321, and a buckling portion 325 hooking the top shell 321 for further fixing the top shell 321 and the bottom shell 322 together. The propping portion 324 and the buckling portion 325 are all inverted-L shaped. The bottom shell 322 further has a buckling piece 326, which may be punched inwards, abutting a bottom of the plug insulating housing 31 for preventing the plug shell 32 from moving frontward with respect to the plug insulating housing 31.

Figure 7:
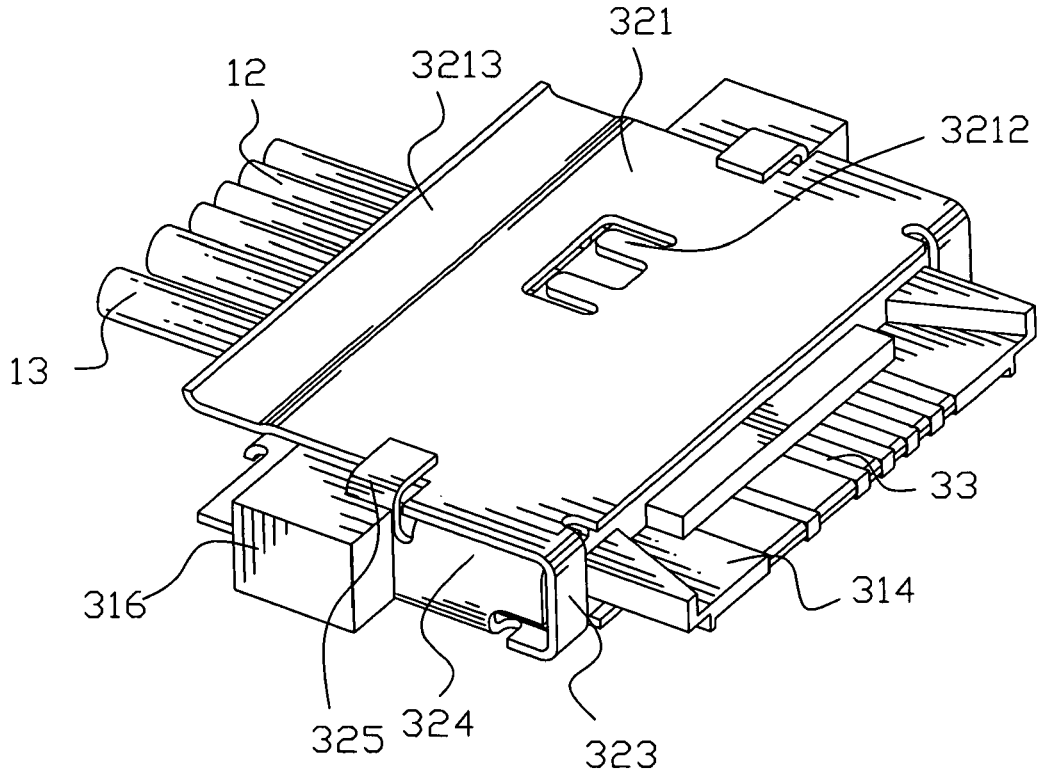
FIG. 7 is an assembled, perspective view of a plug of the cable connector shown in FIG. 2.

Referring to FIGS. 2-3 and FIG. 7, in assembly, the receptacle terminals 22 are inserted into the grooves 212. The receptacle shell 23 is coupled with the receptacle insulating housing 21, with the restraining plates 2311 inserted into the corresponding restraining slots 213 for securing the receptacle shell 23 to the receptacle insulating housing 21. The plug terminals 33 are respectively received in the terminal grooves 315 and the stopping recesses 3112. The first cables 12 and the second cables 13 are partly disposed in the receiving cavity 311 and soldered on the corresponding plug terminals 33 respectively by one end thereof. The plug shell 32 is assembled to the plug insulating housing 31 from a front direction. The connecting portions 323 are attached to the front surface 312 of the basic body 310, and the propping portions 324 and the buckling portions 325 are respectively and partly received in the buckling recesses 318 and the blocking slots 317 for fixing the plug shell 32 to the plug insulating housing 31.

As described above, the connecting portions 323 are connected with the top shell 321 and the bottom shell 322, which avoids separating the top shell 321 from the bottom shell 322 in use. Furthermore, the propping portions 324 support the top shell 321 and the buckling portions 325 clasp the top shell 321, which further fixes the top shell 321 and the bottom shell 322 together. Thus the top shell 321 is connected with the bottom shell 322 firmly and reliably, without easy to separate from each other even if affected by an unexpected force.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A cable connector adapted for connecting with a plurality of cables, comprising:

a plug insulating housing having a basic body and an inserting portion extending frontward from a front surface of the basic body, a peripheral dimension of the inserting portion being less than that of the basic body;

a plurality of plug terminals received in the inserting portion and the basic body and connected with the cables, each of the cables mounted to the plug insulating housing by one end thereof and extending out from the basic body opposite to the inserting portion; and a plug shell coupled with the plug insulating housing comprising a top shell and a bottom shell connected to the top shell by at least one connecting portion attached to the front surface of the basic body, both opposite sides of the bottom shell extending upwards and bending inwards to respectively form a buckling portions clasping the top shell, each buckling portion being formed with an inverted-L shaped contour, a propping portion extends upwards adjacent to the buckling portion and bends inwards to have an inverted-L shaped contour and rests against the top shell for supporting the top shell.

2. The cable connector as claimed in claim 1, wherein the basic body defines a lateral surface having a portion extending outwards and then bent frontward to form a blocking portion, with a blocking slot formed therebetween, the buckling portion is restrained in the blocking slot for fixing the plug shell to the plug insulating housing.

3. The cable connector as claimed in claim 2, wherein the bottom shell has at least one buckling piece resting against a bottom of the basic body for preventing the plug shell from moving frontward with respect to the plug insulating housing.

4. The cable connector as claimed in claim 1, wherein the top of the basic body has two buckling recesses at both opposite sides thereof corresponding to the propping portions for making the plug shell assemble with the plug insulating housing steadily.

5. The cable connector as claimed in claim 1, wherein two connecting portions are disposed to connect two ends of a front of the top shell with two ends of a front of the bottom shell, and adjacent to the inserting portion.

* * * * *